US009739518B2

(12) United States Patent
Moon

(10) Patent No.: US 9,739,518 B2
(45) Date of Patent: Aug. 22, 2017

(54) DISPENSER FOR REFRIGERATOR AND METHOD FOR MANUFACTURING DISPENSER ASSEMBLY

(71) Applicant: Dongbu Daewoo Electronics Corporation, Seoul (KR)

(72) Inventor: Hyoung Kook Moon, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 66 days.

(21) Appl. No.: 14/840,018

(22) Filed: Aug. 30, 2015

(65) Prior Publication Data

US 2016/0370074 A1 Dec. 22, 2016

(30) Foreign Application Priority Data

Jun. 17, 2015 (KR) ..... 10-2015-0086097

(51) Int. Cl.
*F25C 5/00* (2006.01)
*F25D 23/12* (2006.01)
*F25D 23/02* (2006.01)

(52) U.S. Cl.
CPC ..... *F25C 5/005* (2013.01); *F25D 23/028* (2013.01); *F25D 23/126* (2013.01); *F25C 2400/10* (2013.01); *F25D 2323/121* (2013.01)

(58) Field of Classification Search
CPC ..... F25D 23/028; F25D 23/12; F25D 23/126; F25D 2323/121; F25D 2323/122;
(Continued)

(56) References Cited

U.S. PATENT DOCUMENTS 8,413,460 B2 * 4/2013 Yang ..... F25D 23/126 62/389
2004/0187516 A1 * 9/2004 Lee ..... F25C 5/005 62/389

(Continued)

FOREIGN PATENT DOCUMENTS

EP 2357437 A1 8/2011
KR 10-2010-0137378 A 12/2010

OTHER PUBLICATIONS

Extended European Search Report dated Oct. 20, 2016 issued in corresponding European Patent Application No. 15186779.3.

*Primary Examiner* — J. Casimer Jacyna

(57) ABSTRACT

An embodiment of the present invention provides a dispenser for a refrigerator and the dispenser includes a dispenser housing, a removable plate mounted to a top portion of the dispenser housing, an ice chute mounted to a bottom surface of the plate and configured to supply ice, a water outlet mounted to the bottom surface of the plate while being located in front of the ice chute, at a predetermined distance therefrom, and configured to supply water, a first lever mounted to the bottom surface of the plate while being located in front of the ice chute, a second lever mounted to the bottom surface of the plate while being located behind the ice chute, a first switch mounted to a top surface of the plate and configured to be turned on/off by the first lever, a second switch mounted to the top surface of the plate and configured to be turned on/off by the second lever and a control unit for controlling supply of water or ice by receiving a sensing signal from the first switch or the second switch.

13 Claims, 5 Drawing Sheets

(58) Field of Classification Search
CPC .... F25D 29/005; F25C 5/005; F25C 2400/10; B67D 3/0025
USPC ..... 222/146.6; 62/389
See application file for complete search history.

(56) References Cited

U.S. PATENT DOCUMENTS

| | | | | |
|---|---|---|---|---|
| 2008/0173037 | A1 | 7/2008 | Jang et al. | |
| 2008/0178626 | A1 | 7/2008 | Jang et al. | |
| 2010/0319388 | A1 | 12/2010 | Yang et al. | |
| 2011/0079038 | A1 | 4/2011 | Jang et al. | |
| 2011/0083457 | A1 | 4/2011 | Jang et al. | |
| 2013/0075424 | A1 | 3/2013 | Hwang et al. | |
| 2014/0251498 | A1* | 9/2014 | Park | F25D 23/126 141/258 |
| 2015/0300729 | A1* | 10/2015 | Seo | F25D 23/126 62/126 |
| 2016/0334158 | A1* | 11/2016 | Joo | F25D 29/005 |

* cited by examiner

DISPENSER FOR REFRIGERATOR AND METHOD FOR MANUFACTURING DISPENSER ASSEMBLY

RELATED APPLICATION

This application claims priority to Korean Patent Application No. 10-2015-0086097, filed Jun. 17, 2015 for inventor Hyoung Kook Moon. This application is hereby incorporated by reference in its entirety.

FIELD

The present invention relates to a dispenser for a refrigerator and, more particularly, to a dispenser for a refrigerator and a method for manufacturing a dispenser assembly.

BACKGROUND

As is well known, a household refrigeration apparatus (or "refrigerator") is an apparatus which has a certain storage space and keeps food or the like stored therein cool or frozen. The storage space inside the refrigerator may be divided into a cooling compartment, which is kept at a temperature above zero, and a freezing compartment, which is kept at a temperature below zero.

Recently, with the increase in the demand for purified water and ice at home, demand has increased for a refrigeration apparatus equipped with an integral water purifier and ice maker. According to such a type of refrigeration apparatus, the ice maker may be mounted to any one of a freezing compartment, a cooling compartment and a door.

In general, the refrigeration apparatus equipped with the integral water purifier and ice maker has a dispenser provided at a front surface of the door so that water or ice can be dispensed therefrom. A conventional dispenser typically has a structure resembling that shown in FIG. 1.

FIG. 1 is a side sectional view of a conventional dispenser mounted to a refrigeration apparatus.

Referring to FIG. 1, a dispenser body 11 mounted to a front surface of a door of a refrigeration apparatus includes a cavity which is a concave space formed in the door. The cavity may accommodate a water outlet 12, an ice outlet 13, an ice guide 14, a water discharge lever 15 and an ice discharge lever 16.

The ice outlet 13 is formed in a portion of the dispenser body 11, the ice guide 14 is coupled to the front end of the ice outlet 13, and the water outlet 12 is formed in another portion of the dispenser body 11, which is positioned in front of the ice outlet 13.

The water discharge lever 15 has a switch (not shown) provided at a rear surface thereof, and is mounted to a portion (exposed to the front) of the ice guide 14. By pressing the water discharge lever 15, a user can obtain water in a container, such as a cup, from the water outlet 12. Here, the water discharge lever 15 may be, for example, defined as a mechanical switch button.

The ice discharge lever 16 has a switch (not shown) provided at a rear surface thereof, and is mounted to a portion of the inner wall surface of the cavity. By pressing the ice discharge lever 16, a user can dispense ice to a container, such as a cup, through the ice guide 14 from the ice outlet 13. Here, the ice discharge lever 16 may be, for example, defined as a mechanical switch button.

However, in such a conventional dispenser, the water discharge lever 15 and the ice discharge lever 16 are located at different positions in such a manner that the water discharge lever 15 is positioned adjacent to the ice outlet 13 and the ice discharge lever 16 is positioned at the innermost portion of the dispenser cavity of the dispenser body 11, which may increase the complexity of the assembly processes. Further, because the ice discharge lever is directly assembled to the dispenser cavity of the dispenser body 11, even if only the ice discharge lever 16 breaks, there is inconvenience because the whole dispenser must be dissembled in order to be repaired.

SUMMARY

It is an object of the present invention to provide a dispenser for a refrigerator and a method for manufacturing a dispenser assembly, in which the dispenser assembly is modularized by integrally placing (on a single plate) the following: a water outlet; an ice chute, first and second levers for generating a water or ice supply signal when pressed; and first and second switches configured to be turned on/off by the first and second levers, thereby facilitating disassembly and repair of the dispenser.

The objects of the present invention are not limited to the aforesaid, but other objects not described herein will be clearly understood by those skilled in the art from descriptions below.

An embodiment of the present invention provides a dispenser for a refrigerator, wherein the dispenser includes a dispenser housing, a removable plate mounted to a top portion of the dispenser housing, an ice chute mounted to a bottom surface of the plate and configured to supply ice, a water outlet mounted to the bottom surface of the plate while being located in front of the ice chute, at a predetermined distance therefrom, and configured to supply water, a first lever mounted to the bottom surface of the plate while being located in front of the ice chute, a second lever mounted to the bottom surface of the plate while being located behind the ice chute, a first switch mounted to a top surface of the plate and configured to be turned on/off by the first lever, a second switch mounted to the top surface of the plate and configured to be turned on/off by the second lever and a control unit for controlling supply of water or ice by receiving a sensing signal from the first switch or the second switch.

Further, if the first lever is pressed, the first switch transmits a first sensing signal to the control unit and if the control unit receives the first sensing signal, the control unit drives a water purifying unit to supply water from the water outlet.

Further, if the second lever is pressed, the second switch transmits a second sensing signal to the control unit and if the control unit receives the second sensing signal, the control unit drives an ice maker to supply ice from the ice chute.

Further, the first switch and the first lever are respectively mounted to the top surface and the bottom surface of the plate while being vertically aligned with each other.

Further, the second switch and the second lever are respectively mounted to the top surface and the bottom surface of the plate while being vertically aligned with each other.

Another embodiment of the present invention provides a method for manufacturing a dispenser assembly for a refrigerator and the method includes mounting an ice chute for supplying ice to a bottom surface of a plate, mounting a water outlet for supplying water in front of the ice chute, at a predetermined distance therefrom, on the bottom surface of the plate, mounting a first lever in front of the ice chute on the bottom surface of the plate, mounting a first switch to a top surface of the plate, directly above the first lever, and connecting the first lever and the first switch, mounting a second lever behind the ice chute on the bottom surface of the plate, mounting a second switch to the top surface of the plate, directly above the second lever, and connecting the second lever and the second switch and mounting a control unit electrically connected to the first switch or the second switch so as to receive a sensing signal from the first switch or the second switch.

Further, the ice chute, the water outlet, the first lever, the second lever, the first switch, the second switch and the control unit may be integrally mounted on the plate to modularize a dispenser assembly.

Further, the method comprises mounting the dispenser assembly to a top portion of a dispenser housing after mounting the control unit.

In one embodiment, if the first lever is pressed, the first switch transmits a first sensing signal to the control unit and if the control unit receives the first sensing signal, the control unit drives a water purifying unit so as to supply water from the water outlet.

if the second lever is pressed, the second switch transmits a second sensing signal to the control unit, and Further, if the control unit receives the second sensing signal, the control unit drives an ice maker so as to supply ice from the ice chute.

A dispenser for a refrigerator according to embodiments of the present invention is constructed in a modular fashion by integrally placing on a single plate a water outlet, an ice chute, first and second levers for generating a water or ice supply signal by being pressed, and first and second switches configured to be turned on/off by the first and second levers. Accordingly, the dispenser mounting process may be made more convenient. Further, when the dispenser malfunctions, disassembly and repair may be facilitated.

DETAILED DESCRIPTION OF THE EMBODIMENTS

The features and other advantages of the present invention will be more clearly understood from the following detailed description taken in conjunction with the accompanying drawings. It should be understood that the present invention is not limited to the following embodiments and may be embodied in different ways. The following embodiments are given by way of illustration to provide a thorough understanding of the disclosure to those skilled in the art. Hence, it should be understood that other embodiments will be evident based on the present disclosure, and that system, process or mechanical changes may be made without departing from the scope of the present disclosure.

In the following description of the present invention, a detailed description of known functions and configurations incorporated herein will be omitted when it may obscure the subject matter of the present invention. Also, the terms used in the following description are terms defined taking into consideration the functions obtained in accordance with the present invention. The definitions of these terms should be determined based on the whole content of this specification because they may be changed in accordance with the option of a user or chip designer or a usual practice.

Hereinafter, preferred embodiments of the present invention will be described in detail with reference to the attached drawings.

Figure 1:
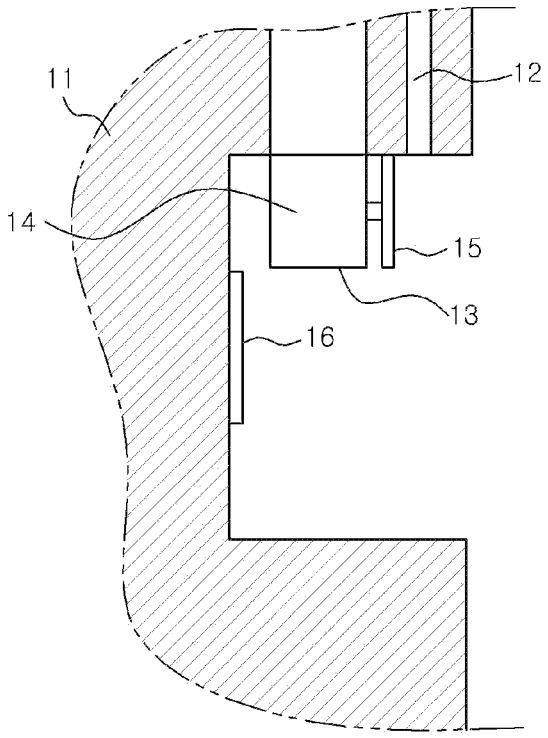
FIG. 1 is a side sectional view of a conventional dispenser mounted to a refrigeration apparatus.
Figure 2:
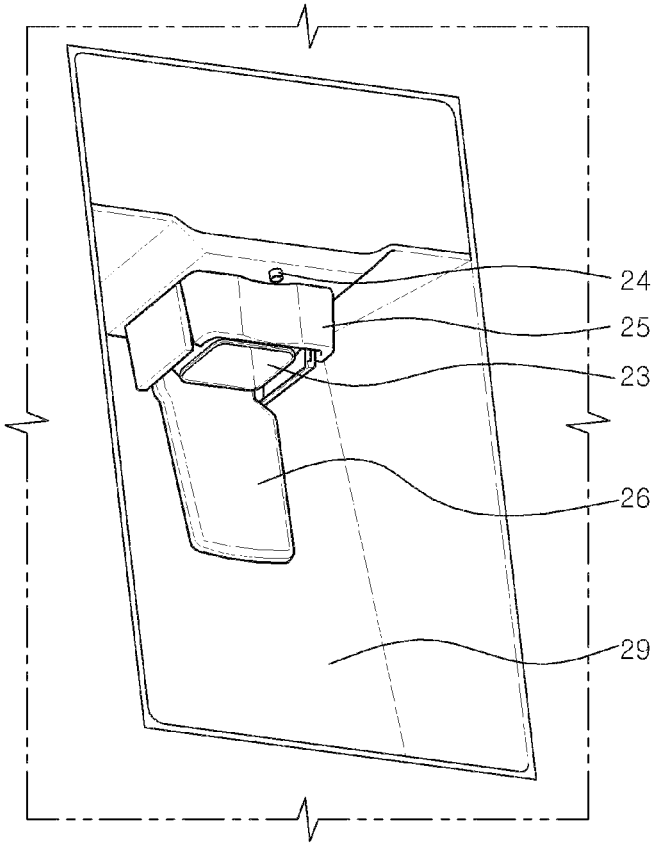
FIG. 2 is a perspective view of a dispenser for a refrigerator according to an embodiment of the present invention.
Figure 3:
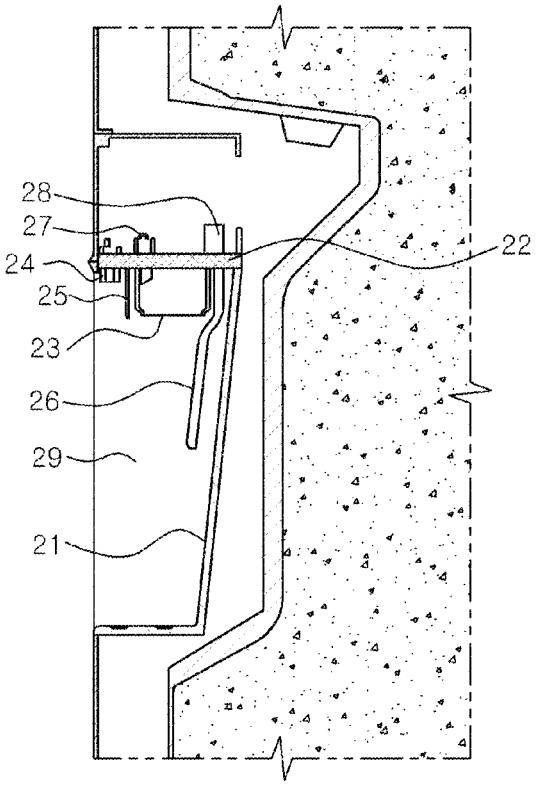
FIG. 3 is a side sectional view of a dispenser for a refrigerator according to an embodiment of the present invention.

FIG. 2 is a perspective view of a dispenser for a refrigerator according to an embodiment of the present invention, and FIG. 3 is a side sectional view of a dispenser for a refrigerator according to an embodiment of the present invention.

Referring to FIGS. 2 and 3, a dispenser for a refrigerator according to an embodiment of the present invention may comprise a dispenser housing 21, a plate 22, an ice chute 23, a water outlet 24, a first lever 25, a second lever 26, a first switch 27, a second switch 28, and a control unit (not shown). However, this combination is merely illustrative, and according to embodiments, at least one of the above components may be omitted or other components may be added.

The dispenser housing 21 can be a case formed with a dispenser cavity 29, which is a concave space formed to a predetermined depth in the front surface of the door. The ice chute 23, the water outlet 24, the first lever 25, the second lever 26, the first switch 27 and the second switch 28 are assembled with the plate 22, and the plate 22 may be disposed at the top portion of the dispenser housing 21.

In detail, the removable plate 22 is mounted to the top portion of the dispenser housing 21, and may form a dispenser assembly together with the ice chute 23, the water outlet 24, the first lever 25, the second lever 26, the first switch 27 and the second switch 28. According to embodiments, the control unit (not shown), which receives a sensing signal from the first switch or the second switch and drives a water purifying unit (not shown) or an ice maker (not shown) according to the sensing signal in order to supply water or ice, may also be assembled with the plate 22.

In this way, the dispenser assembly is modularized by integrally placing the ice chute 23, the water outlet 24, the first and second levers 25 and 26 for generating the water or ice supply signal when pressed, and the first and second switches 27 and 28 configured to be turned on/off by the first and second levers 25 and 26, on the plate 22. Therefore, the dispenser mounting time may be shortened, and when the dispenser malfunctions, disassembly and repair may be less cumbersome.

The ice chute 23 is an outlet for supplying ice to a user when the second lever 26 is pressed by the user. Describing the process of discharging ice from the ice chute 23 in detail, if the second lever 26 is pressed by the user, the second switch 28 senses the press and transmits a second sensing signal to the control unit (not shown). If the control unit (not shown) receives the second sensing signal, the control unit. (not shown) drives the ice maker so as to supply ice from the ice chute 23.

The ice chute 23 is mounted on the bottom surface of the plate 22. The first lever 25 is arranged in front of the ice chute 23, and the second lever 26 is arranged behind the ice chute 23.

The water outlet 24, similarly to the ice chute 23, is also mounted on the bottom surface of the plate 22, and is disposed at the outermost portion of the dispenser cavity 29 formed in the dispenser housing 21. When observed from the user's standpoint, the water outlet 24 is located at the closest position to the user, for greater usability. This makes it easy to even get water in, for example, a large-volume container such as, for example, a sports water bottle. If the water outlet 24 were disposed at a relatively deep inner portion of the dispenser cavity 29, it would be very inconvenient to get water in a tall water bottle that may not be accommodated in the dispenser cavity 29.

The water outlet 24 is an outlet for supplying water for the user when the first lever 25 is pressed by the user. Describing the process of discharging water from the water outlet 24 in detail, if the first lever 25 is pressed by the user, the first switch 27 senses the interaction and transmits a first sensing signal to the control unit. (not shown). If the control unit (not shown) receives the first sensing signal, the control unit (not shown) drives the water purifying unit (not shown) to supply water from the water outlet 24.

The first lever 25 is mounted on the bottom surface of the plate 22, and is arranged in front of the ice chute 23. If the first lever 25 is pressed by the user, water is discharged from the water outlet 24. The first lever 25 may be arranged close to the water outlet 24 so that the user can obtain or dispense water in a cup or water bottle from the water outlet 24 while pressing the first lever 25 with the outer side surface of the cup or water bottle.

The first lever 25 may be pushed by a user when he or she wants to dispense water. If the first lever 25 is pressed by the user, the first switch 27 transmits the sensing signal related thereto to the control unit (not shown), and the control unit (not shown) controls the water purifying unit. (not shown) so that the user can dispense water from the water outlet 24.

The second lever 26 is mounted on the bottom surface of the plate 22, and is arranged behind the ice chute 23. If the second lever 26 is pressed by the user, ice is discharged from the ice chute 23. The second lever 26 may be arranged close to the ice chute 23 so that the user dispense ice in a cup or water bottle from the ice chute 23 while pressing the second lever 26 with the outer side surface of the cup or water bottle.

The second lever 26 may be pushed by a user when he or she wants to obtain ice. If the second lever 26 is pressed by the user, the second switch 28 transmits the sensing signal related thereto to the control unit (not shown), and the control unit (not shown) controls the ice maker (not shown) so that the user can get ice from the ice chute 23.

The first switch 27 is disposed on the top surface of the plate 22 and is positioned directly above the first lever 25. That is, when observed lengthwise, the first lever 25, the plate 22 and the first switch 27 are arranged in order from the bottom.

If the first switch 27 senses that the user is pressing the first lever 25, the first switch 27 transmits the first sensing signal, indicating that the user is pressing the first lever 25, to the control unit (not shown). If the control unit (not shown) receives the first sensing signal, the control unit (not shown) controls the water purifying unit. (not shown) so that the user can receive water from the water outlet 24. In other words, the first switch 27 functions to determine whether the user is pressing the first lever 25 to obtain water, and if the first lever 25 is pressed, the first switch 27 generates the first sensing signal and transmits the same to the control unit. (not shown).

The second switch 28 is disposed on the top surface of the plate 22 and is positioned directly above the second lever 26. That is, when observed lengthwise, the second lever 26, the plate 22 and the second switch 28 are arranged in order from the bottom.

If the second switch 28 senses that the user is pressing the second lever 26, the second switch 28 transmits the second sensing signal, indicating that the user is pressing the second lever 25, to the control unit (not shown). If the control unit not shown) receives the second sensing signal, the control unit (not shown) controls the ice maker (not shown) so that the user can receive ice from the ice chute 23. In other words, the second switch 28 functions to determine whether the user is pressing the second lever 26 to obtain ice, and if the second lever 26 is pressed, the second switch 28 generates the second sensing signal and transmits the same to the control unit (not shown).

The dispenser cavity 29 refers to a concave space in the dispenser housing 21, which is formed to a predetermined depth in the front surface of the door.

If the user presses the first lever 25 or the second lever 26, the first switch 27 or the second switch 28 senses the user's interaction and transmits the first sensing signal or the second sensing signal to the control unit (not shown), and then the control unit (not shown) performs processes corresponding thereto. That is, if the control unit (not shown) receives the first sensing signal, the control unit (not shown) drives the water purifying unit (not shown) to supply water from the water outlet 24. If the control unit (not shown) receives the second sensing signal, the control unit (not shown) drives the ice maker (not shown) so that the user can receive ice from the ice chute 23.

Although not shown in the drawings, the control unit (not shown) may be disposed on the top surface of the plate 22, or may be disposed apart from the dispenser assembly arranged on the top surface of the plate. Because the control unit (not shown) is only electrically connected to the first switch 27 or the second switch 28, the control unit (not shown) does not need to be mounted on the top surface of the plate 22 and physically integrated with the dispenser assembly. Because the control unit. (not shown) is also electrically connected to the water purifying unit (not shown) or the ice maker (not shown), the control unit (not shown) can transmit control signals to the water purifying unit (not shown) or the ice maker (not shown) in order to control the same as needed.

As described above, the dispenser according to an embodiment of the present invention is constituted such that the dispenser assembly is modularized by integrally placing on the plate 22 the following: the ice chute 23; the water outlet 24; the first and second levers 25 and 26 for generating the water or ice supply signal when pressed; and the first and second switches 27 and 28 configured to be turned on/off by the first and second levers 25 and 26. Therefore, the dispenser mounting time may be shortened, and when the dispenser malfunctions, disassembly and repair may be facilitated.

Figure 4:
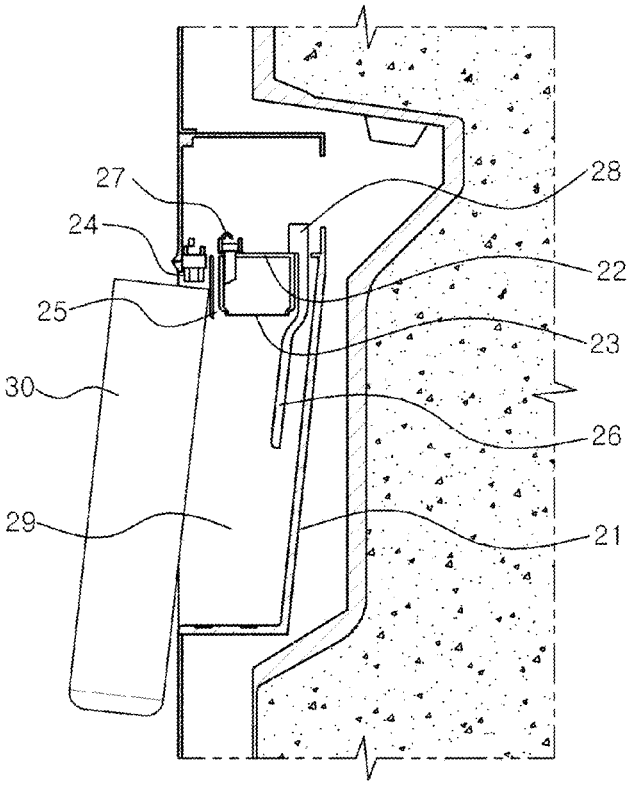
FIG. 4 is a view illustrating an exemplary operation of taking out water using a dispenser according to an embodiment of the present invention.

FIG. 4 is a view illustrating an exemplary operation of taking out water using the dispenser according to an embodiment of the present invention. Referring to FIG. 4, when the user wants to fill a water bottle 30 from the dispenser according to an embodiment of the present invention, he or she presses the first lever 25 with the outer side surface of the water bottle 30. If the first switch 27 senses that the first lever 25 is being pressed, the first switch 27 generates the first sensing signal and transmits the same to the control unit (not shown). If the control unit (not shown) receives the first sensing signal, the control unit (not shown) drives the water purifying unit (not shown) to supply water from the water outlet 24.

In order to get water in the water bottle 30 while pressing the first lever 25 with the outer side surface of the water bottle 30, the user tilts the water bottle 30 toward the water outlet 24 so that the opening of the water bottle 30 faces the water outlet 24. In order to allow the user to fill the water bottle 30 with water while pressing the first lever 25 with the outer side surface of the water bottle 30, the first lever 25 should be located sufficiently close to the water outlet 24. Since the dispenser according to an embodiment of the present invention is structured such that the water outlet 24 and the first lever 25 are located sufficiently close to each other on the bottom surface of the plate 22, it is easy for the user to get water in the water bottle 30 while pressing the first lever 25 with the outer side surface of the water bottle 30. Further, since the water outlet 24 is located at the outermost portion of the dispenser cavity 29 formed in the dispenser housing 21, it is easy to get water even when the user uses a large-volume sports water bottle as the water bottle 30 for instance as shown in FIG. 4.

Figure 5:
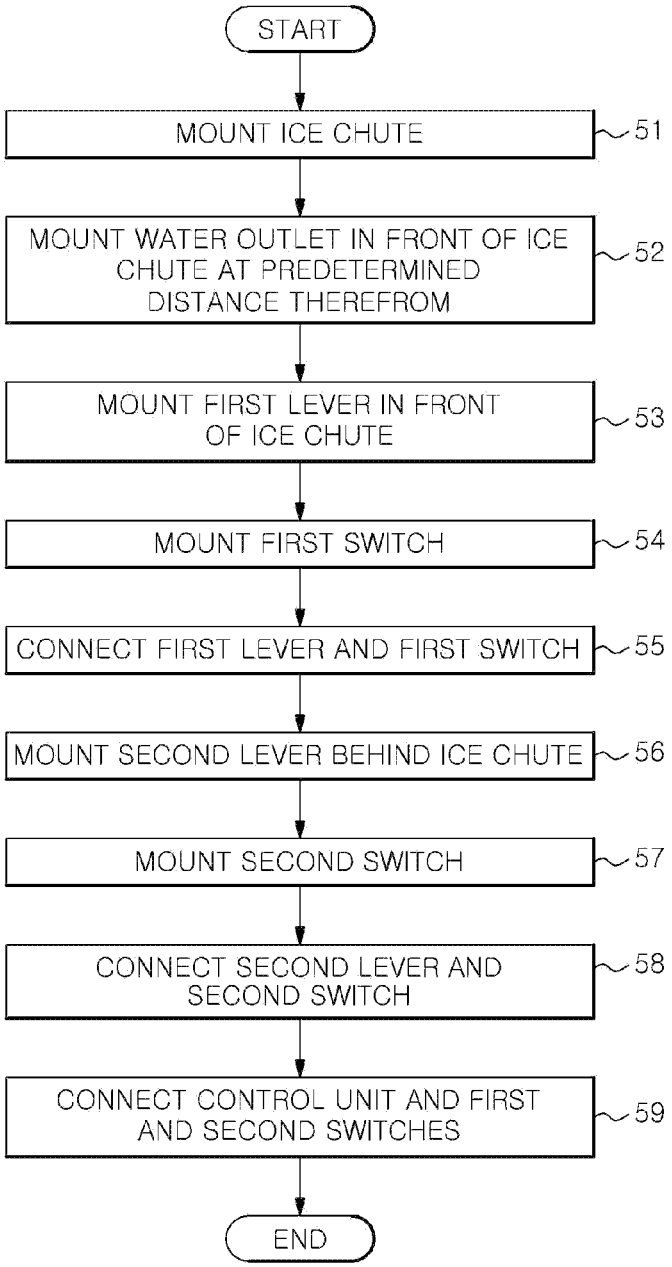
FIG. 5 is a flowchart illustrating an exemplary method for manufacturing a dispenser assembly according to an embodiment of the present invention.

FIG. 5 is a flowchart illustrating a method for manufacturing the dispenser assembly according to an embodiment of the present invention. Referring to FIG. 5, the ice chute 23 for supplying ice is first assembled to the bottom surface of the plate 22 (step 51). Next, the water outlet 24 for supplying water is assembled to the bottom surface of the plate 22 while being located in front of the ice chute 23, at a predetermined distance therefrom (step 52). Since the water outlet 24 is located at the outermost portion of the dispenser cavity 29 formed in the dispenser housing 21 so as to be closest to the user, usability may be increased.

Then, the first lever 25 is mounted to the bottom surface of the plate 22 while being located in front of the ice chute 23 (step 53). The first switch 27 is mounted on the top surface of the plate 22 while being located directly above the first lever 25 (step 54), and the first lever 25 and the first switch 27 are connected to each other (step 55). By this structure, in which the first lever 25 and the first switch 27 are located close to e other and are mechanically connected to each other, when the user presses the first lever 25 to obtain water, the first switch 27 senses that the user is pressing the first lever 25, generates the first sensing signal related thereto, and transmits the same to the control unit (not shown).

Next, the second lever 26 is mounted to the bottom surface of the plate 22 while being located behind the ice chute 23 (step 56). The second switch 28 is mounted on the top surface of the plate 22 while being located directly above the second lever 26 (step 57), and the second lever 26 and the second switch 28 are connected to each other (step 58). By this structure, in which the second lever 26 and the second switch 28 are located close to each other and are mechanically connected to each other, when the user presses the second lever 26 obtain ice, the second switch 28 senses that the user is pressing the second lever 26, generates the second sensing signal related thereto, and transmits the same to the control unit (not shown).

Next, the control unit, which is electrically connected to the first switch 27 or the second switch 28 to receive the sensing signal therefrom, is mounted (step 59). The control unit (not shown) may be mounted to the top surface of the plate 22. However, because the control unit (not shown), which is electrically connected to the first switch 27 or the second switch 28, does not need to be mechanically connected to the switch 27 or 28, the control unit (not shown) is not, necessarily mounted to the top surface of the plate 22.

As described above, the method for manufacturing the dispenser assembly according to an embodiment of the present invention provides a dispenser assembly that is modularized by integrally placing on a single plate 22 the ice chute 23, the water outlet 24, the first and second levers 25 and 26 for generating the water or ice supply signal when pressed, and the first and second switches 27 and 28 configured to be turned on/off by the first and second levers 25 and 26. Such a modularized dispenser assembly is simply mounted to the dispenser housing, which results in a reduction of the required time. Advantageously, when the dispenser malfunctions, only the dispenser assembly needs to be disassembled and repaired, without the necessity of disassembling the entire dispenser housing. Accordingly, disassembly and repair of the broken dispenser may be facilitated.

Although exemplary embodiments of the present invention have been described for illustrative purposes, those skilled in the art will appreciate that various modifications, additions and substitutions are possible, without departing from the scope and spirit of the invention as disclosed in the accompanying claims. Therefore, the embodiment disclosed in the present invention is intended to illustrate the scope of the technical idea of the present invention, and the scope of the present invention is not limited by the embodiment.

The scope of the present invention shall be construed on the basis of the accompanying claims, and it shall be construed that all of the technical ideas included within the scope equivalent to the claims belong to the present invention.

What is claimed is:

1. A dispenser for a refrigerator, the dispenser comprising:
- a dispenser housing;
- a plate removably mounted to a top portion of the dispenser housing;
- an ice chute mounted to a bottom surface of the plate and configured to supply ice;
- a water outlet mounted to the bottom surface of the plate and located in front of the ice chute, at a predetermined distance therefrom, and configured to supply water;
- a first lever mounted to the bottom surface of the plate and located in front of the ice chute;
- a second lever mounted to the bottom surface of the plate and being located behind the ice chute;
- a first switch mounted to a top surface of the plate and configured to be activated by the first lever;
- a second switch mounted to the top surface of the plate and configured to be activated by the second lever; and
- a control unit for controlling a supply of water or ice by receiving a sensing signal from the first switch or the second switch.

2. The dispenser according to claim 1, wherein the first switch is operable to transmit a first sensing signal to the control unit responsive to the first lever being pressed, and
- wherein the control unit is operable to drive a water purifying unit to supply water from the water outlet responsive to receive the first sensing signal.

3. The dispenser according to claim 1, wherein the second switch is operable to transmit a second sensing signal to the control unit responsive to the second lever being pressed, and the control unit operable to drive an ice maker to supply ice from the ice chute responsive to receiving the second sensing signal.

4. The dispenser according to claim 1, wherein the first switch and the first lever are vertically aligned with each other.

5. The dispenser according to claim 1, wherein the second switch and the second lever are vertically aligned with each other.

6. A method for manufacturing a dispenser assembly for a refrigerator, the method comprising:

mounting an ice chute for supplying ice to a bottom surface of a plate;

mounting a water outlet for supplying water in front of the ice chute, at a predetermined distance therefrom, on the bottom surface of the plate;

mounting a first lever in front of the ice chute on the bottom surface of the plate;

mounting a first switch to a top surface of the plate, directly above the first lever, and connecting the first lever and the first switch;

mounting a second lever behind the ice chute on the bottom surface of the plate;

mounting a second switch to the top surface of the plate, directly above the second lever, and connecting the second lever and the second switch; and mounting a control unit electrically connected to the first switch or the second switch to receive a sensing signal from the first switch or the second switch.

7. The method according to claim 6, further comprising the first switch transmitting a first sensing signal to the control unit responsive to the first lever being pressed, and the control unit driving a water purifying unit to supply water from the water outlet responsive to receiving the first sensing signal.

8. The method according to claim 6, further comprising the second switch transmitting a second sensing signal to the control unit responsive to the second lever being pressed, and the control unit driving an ice maker to supply ice from the ice chute responsive to receiving the second sensing signal.

9. A refrigerator comprising:

a cooling chamber;

doors for closing the cooling chamber;

a dispenser, comprising:

a dispenser housing;

a plate removably mounted to a top portion of the dispenser housing;

an ice chute mounted to a bottom surface of the plate and configured to supply ice;

a water outlet mounted to the bottom surface of the plate and located in front of the ice chute, at a predetermined distance therefrom, and configured to supply water;

a first lever mounted to the bottom surface of the plate and located in front of the ice chute;

a second lever mounted to the bottom surface of the plate and being located behind the ice chute;

a first switch mounted to a top surface of the plate and configured to be activated by the first lever;

a second switch mounted to the top surface of the plate and configured to be activated by the second lever; and a control unit for controlling a supply of water or ice by receiving a sensing signal from the first switch or the second switch.

10. The refrigerator according to claim 9, wherein the first switch is operable to transmit a first sensing signal to the control unit responsive to the first lever being pressed, and wherein the control unit is operable to drive a water purifying unit to supply water from the water outlet responsive to receive the first sensing signal.

11. The refrigerator according to claim 9, wherein the second switch is operable to transmit a second sensing signal to the control unit responsive to the second lever being pressed, and the control unit operable to drive an ice maker to supply ice from the ice chute responsive to receiving the second sensing signal.

12. The refrigerator according to claim 9, wherein the first switch and the first lever are vertically aligned with each other.

13. The refrigerator according to claim 9, wherein the second switch and the second lever are vertically aligned with each other.

* * * * *